United States Patent [19]

DeSantis

[11] Patent Number: 4,856,990

[45] Date of Patent: Aug. 15, 1989

[54] SAGGER CONSTRUCTION

[75] Inventor: Raymond P. DeSantis, Troy, Mich.

[73] Assignee: PTX-Pentronix, Inc., Lincoln Park, Mich.

[21] Appl. No.: 213,324

[22] Filed: Jun. 30, 1988

[51] Int. Cl.[4] ..... F27D 5/00

[52] U.S. Cl. ..... 432/258; 206/443; 206/564; 264/57; 432/261

[58] Field of Search ..... 432/258, 259, 261; 206/443, 564; 264/57, 58, 59

[56] References Cited

U.S. PATENT DOCUMENTS

| | | | |
|---|---|---|---|
| 1,921,228 | 8/1933 | Hethington | 206/443 |
| 3,237,786 | 3/1966 | Milliken | 206/443 |
| 3,272,371 | 9/1966 | Weiner | 206/443 |
| 3,590,752 | 7/1971 | De Pew | 206/443 |
| 4,195,734 | 4/1980 | Boner et al. | 206/564 |
| 4,396,120 | 8/1983 | Morita | 206/443 |

*Primary Examiner*—Henry C. Yuen

*Attorney, Agent, or Firm*—Gifford, Groh, Sheridan, Sprinkle and Dolgorukov

[57] ABSTRACT

A rectangular sagger structure particularly suited for firing cylindrical articles loaded in parallel touching rows. A scalloped fixture extends inwardly from one of the side walls with the scalloped notches so spaced that the articles placed in the notches constituting a first row of articles form pockets for the second row of articles to nest between adjacent first row articles.

5 Claims, 1 Drawing Sheet

SAGGER CONSTRUCTION

BACKGROUND OF THE INVENTION

1. Field of Invention

This invention relates to saggers, and, more particularly, to a sagger construction particularly adapted for stacking cylindrical articles to be fired such as spark plugs in a vertical orientation.

2. Description of the Prior Art

Because of the thermal stresses to which saggers are subject by repeated firings often under rapid heating and cooling cycles, the design of a sagger is usually maintained relatively simple. Most saggers are of a topless square or rectangular configuration. Sometimes, when multiple layers are fired, saggers are constructed with a first sagger having a bottom wall and other saggers to be stacked vertically on top of the first sagger are constructed without a bottom wall so that the saggers can be successively loaded. Some saggers have a bottom which can be removed for rapid discharge of the fired articles.

When generally elongated bodies are fired such as cylindrical parts or rectangular parts, for example, tool bits or spark plugs, maximum loading is facilitated by utilizing a packingg material within the sagger to maintain the parts upright, that is, with their axis in a vertical position. The use of packings or alternatively inserts such as those that have an egg-crate appearance, helps to maintain the parts in a vertical position until they have been fired and allows maximum density placement of the parts within the saggers. Usually the packing or inserts are burned away during the firing process so that the parts fall over in a random orientation during the firing process. This sometimes causes breakage of the parts during the firing or the unloading process. Also, while a packing or an insert allows the parts to be properly oriented, they do not lend themselves to use with automatic loaders such as those shown in my U.S. Pat. Nos. 4,550,551 and 4,594,839. A high degree of success has been obtained by utilizing the loading mechanism described and shown in the foregoing patents. Typically the automatic loader is used with such articles as rectangular carbide cutting inserts and the like which are packed in a series of horizontal rows with the axis of the parts being maintained generally vertical. This invention is directed primarily to an improvement in a rectangular sagger construction for use with loaders that load parts singly or a row of parts at a time or to facilitate the manual loading of parts particularly cylindrical parts which can be nested within each other in the loading process.

SUMMARY OF THE INVENTION

The present invention provides a sagger for use in firing elongated ceramic articles in a substantially vertical position. The sagger is a topless rectangular box which includes four side walls and a bottom wall. The bottom wall can be in the form of a loose member. An article orientating serrated fixture extends inwardly from one side wall having uniformly spaced notches to accommodate a first row of articles in the notches parallel to the side wall. The notches extend inwardly from a planar wall parallel to the box side wall with a depth and configuration which allows the articles to extend outwardly to form pockets so that articles placed in a second row will nest within adjacent articles in the first row. The articles in the second row will contact one of the articles in the first row and the planar surface or an adjacent articles in the first row without contacting the planar surface. This provides the foundation for additional sequential rows until the sagger box is completely full.

In one preferred form, the notches take the form of uniformly spaced scallops with a circular segment configuration and a diameter equal to or slightly larger than the diameter of the articles. The scallops are spaced apart a distance between 1 to less than 2 times the diameters of the articles. Obviously the scallops can take other forms when non-cylindrical articles are to be carried on the sagger.

DETAILED DESCRIPTION OF THE PREFERRED EMBODIMENT

Figure 1:
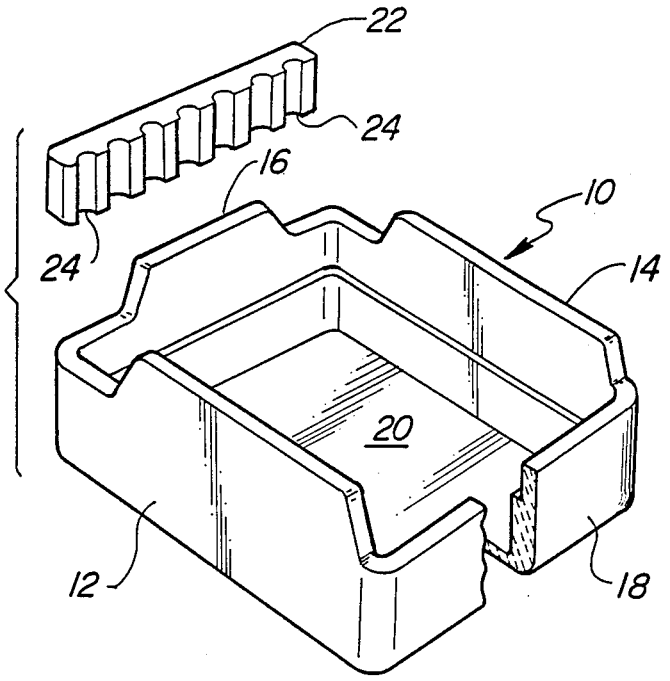
FIG. 1 is an exploded perspective view of the sagger of this invention showing the serrated fixture as a separate element for insertion into the rectangular sagger in contact with one of its side walls.
Figure 2:
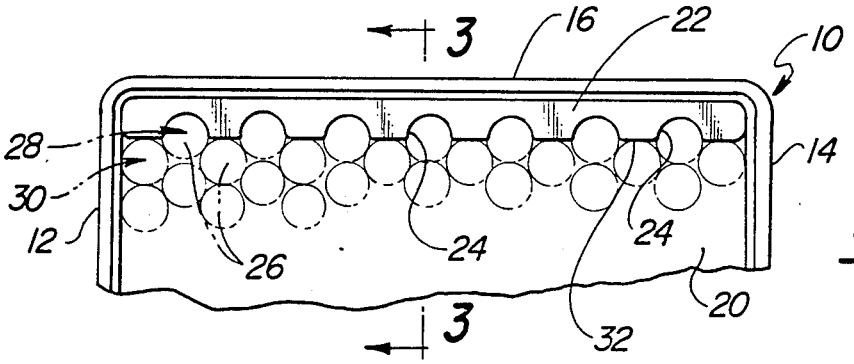
FIG. 2 is a fragmentary partial plan view of the sagger box with the fixture extending inwardly from one side wall and showing in phantom cylindrical articles to be fired placed in three successive parallel rows and showing the start of a fourth row.

Sagger 10 of this invention is shown as a substantially rectangular box having two pairs of opposed side walls 12, 14 and 16, 18. Box 10 has an open top and a closed bottom wall 20. Scalloped fixture 22 is shown in FIG. 1 as being a separate part for insertion into the rectangular sagger 10 contiguous with one of the side walls 16. The fixtures 22 can also be formed integrally with one of the sagger sidewalls. Fixture 22 has a planar surface 32 with spaced notches in the form of scallops 24 which are circle segments which are spaced apart a distance equal to between 1 and 2 times the diameter of the cylindrical parts or articles 26 to be fired in the sagger. Typically these parts can be spark plugs which have multiple diameters, the spacing between the scallops on the fixture accommodating the largest diameter of the spark plug so that when the articles have been placed in the first row, the articles in the second row 30 will nest between adjacent articles in the first row 28. This nesting is best seen in FIG. 2. Each article in the second row can contact the planar surface 32 and one of the articles in the first row, or the article in the second row can be in contact with two adjacent articles in the first row.

Figure 3:
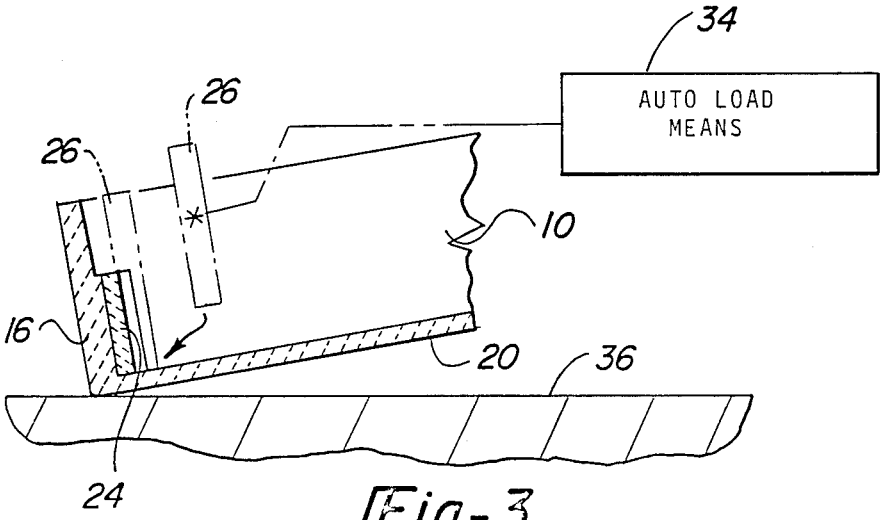
FIG. 3 is a fragmentary elevational view in section taken along line 3—3 of FIG. 2 showing a sagger being loaded with articles by an automatic loading means as the sagger is being held at an angle to the horizontal with articles already in place in the first row in contact with the fixture and a second row being placed into the pockets formed by the articles in the first row.

FIG. 3 shows an automatic loading mechanism 34 which loads the individual articles 26 one at a time or a row at a time into the sagger 10 as shown. Typically the sagger is tilted at an angle with respect too the horizontal loading surface 34 to keep the articles in position until the entire sagger has been loaded.

While the preferred embodiment employs a scallops with a circular segment cross section, it will be appreciated that notches of other configurations can be used such as a V-notch, or the scallop can have a central circular segment portion with straight tangential portions joining the planar surfaces 32. In either construction, the center of the circular segment portion is preferably in line with planar fixture surface 32 or slightly above it. Typically the sagger and its separate or integral fixture is made with a high alumina material.

The embodiments of the invention in which an exclusive property or privilege is claimed are defined as follows:

1. A sagger for use in firing elongated articles in a substantially vertical position comprising: a topless rectangular box including four side walls and a bottom wall; and an article oriented serrated fixture extending inwardly from one side wall, said fixture having uniformly spaced notches to accommodate a first row of articles therein substantially parallel to said one side wall and said notches having a depth and configuration which allows said articles to extend outwardly a distance so that articles placed in a second row will be nested within adjacent articles in said first row and will contact adjacent articles in said first row.

2. The sagger according to claim 1 wherein said notches are spaced apart a distance between 1 to less than 2 times the diameter of said articles.

3. The sagger according to claim 1 wherein said notches are scallops with circular segment configurations.

4. The sagger according to claim 1 wherein said fixture extends upwardly from said bottom wall to a point below the top of said one side wall.

5. The sagger according to claim 1 wherein said fixture is formed separately from said box and is inserted into said box in contact with said one side wall and the bottom wall of said box.

* * * * *